US011262070B2

(12) United States Patent
Billman et al.

(10) Patent No.: US 11,262,070 B2
(45) Date of Patent: Mar. 1, 2022

(54) CLOSED-LOOP SIMMER WITH A GAS BURNER

(71) Applicant: Haier US Appliance Solutions, Inc., Wilmington, DE (US)

(72) Inventors: David William Billman, Louisville, KY (US); Jennifer Nicole Lea, Louisville, KY (US); Michael Blum, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 230 days.

(21) Appl. No.: 16/702,794

(22) Filed: Dec. 4, 2019

(65) Prior Publication Data

US 2021/0172602 A1 Jun. 10, 2021

(51) Int. Cl.

| | |
|---|---|
| ***F23N 5/20*** | (2006.01) |
| ***F24C 3/12*** | (2006.01) |
| ***F23N 1/00*** | (2006.01) |
| ***F23N 5/14*** | (2006.01) |
| ***F23N 5/10*** | (2006.01) |

(52) U.S. Cl.

CPC ..... *F23N 5/203* (2013.01); *F23N 1/005* (2013.01); *F23N 5/10* (2013.01); *F23N 5/14* (2013.01); *F24C 3/126* (2013.01); *F23N 2223/22* (2020.01); *F23N 2225/16* (2020.01); *F23N 2241/08* (2020.01)

(58) Field of Classification Search

None

See application file for complete search history.

(56) References Cited

U.S. PATENT DOCUMENTS

| | | | | |
|---|---|---|---|---|
| 5,575,638 | A * | 11/1996 | Witham | F24C 3/126 431/73 |
| 7,255,100 | B2 * | 8/2007 | Repper | F23N 5/203 126/39 BA |
| 10,935,250 | B2 * | 3/2021 | Querejeta Andueza | F23N 1/002 |
| 11,015,813 | B2 * | 5/2021 | Billman | G05B 11/42 |
| 2021/0285649 | A1 * | 9/2021 | Billman | F24C 3/126 |

* cited by examiner

*Primary Examiner* — David J Laux

(74) *Attorney, Agent, or Firm* — Dority & Manning, P.A.

(57) ABSTRACT

A method of operating a cooktop appliance includes inputting a temperature measurement and a set temperature into a closed-loop control algorithm. When the output of the closed-loop control algorithm is less than a power level threshold, a first control valve to a gas burner of the cooktop appliance is closed.

18 Claims, 5 Drawing Sheets

CLOSED-LOOP SIMMER WITH A GAS BURNER

FIELD OF THE INVENTION

The present subject matter relates generally to cooktop appliances with gas burner assemblies, such as gas range appliances or gas stove appliances.

BACKGROUND OF THE INVENTION

Certain cooktop appliances include gas burners for heating cooking utensils on the cooktop appliances. Some users prefer gas burners over electric heating elements due to the adjustability of gas burners. In particular, a gas burner's control valve can provide more heat outputs compared to the discrete number of output settings available for electric heating elements. However, precisely heating a cooking utensil with a gas burner can be difficult. For example, a user may have to constantly monitor the cooking utensil and tweak the control valve to maintain a particular temperature in the cooking utensil, and such monitoring and adjustment can be tedious.

Accordingly, a cooktop appliance with features for operating a gas burner to maintain a particular temperature in a cooking utensil would be useful.

BRIEF DESCRIPTION OF THE INVENTION

Aspects and advantages of the invention will be set forth in part in the following description, or may be apparent from the description, or may be learned through practice of the invention.

In one example embodiment, a method of operating a cooktop appliance is provided. The cooktop appliance includes a gas burner. The method includes receiving a user-determined set temperature from a user interface of the cooktop appliance and activating the gas burner. The method also includes receiving a precision mode initiation signal from the user interface. The method further includes receiving a temperature measurement from a temperature sensor configured to measure a temperature at a utensil heated by the gas burner. The user-determined set temperature and the temperature measurement are input into a closed-loop control algorithm. The closed-loop control algorithm produces an output based on the user-determined set temperature and the temperature measurement. The method also includes comparing the output of the closed-loop control algorithm to a threshold power level. When the output of the closed-loop control algorithm is less than the threshold power level, a first control valve to the gas burner is closed.

In another example embodiment, a method of operating a cooktop appliance is provided. The cooktop appliance includes a gas burner. The method includes receiving a user-determined set temperature from a user interface of the cooktop appliance and activating the gas burner. The method also includes receiving a precision mode initiation signal from the user interface. The method further includes receiving a temperature measurement from a temperature sensor configured to measure a temperature at a utensil heated by the gas burner. The user-determined set temperature and the temperature measurement are input into a closed-loop control algorithm. The closed-loop control algorithm produces an output based on the user-determined set temperature and the temperature measurement. The method also includes comparing the output of the closed-loop control algorithm to a threshold power level. When the output of the closed-loop control algorithm is less than the threshold power level, a first control valve to the gas burner is closed.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
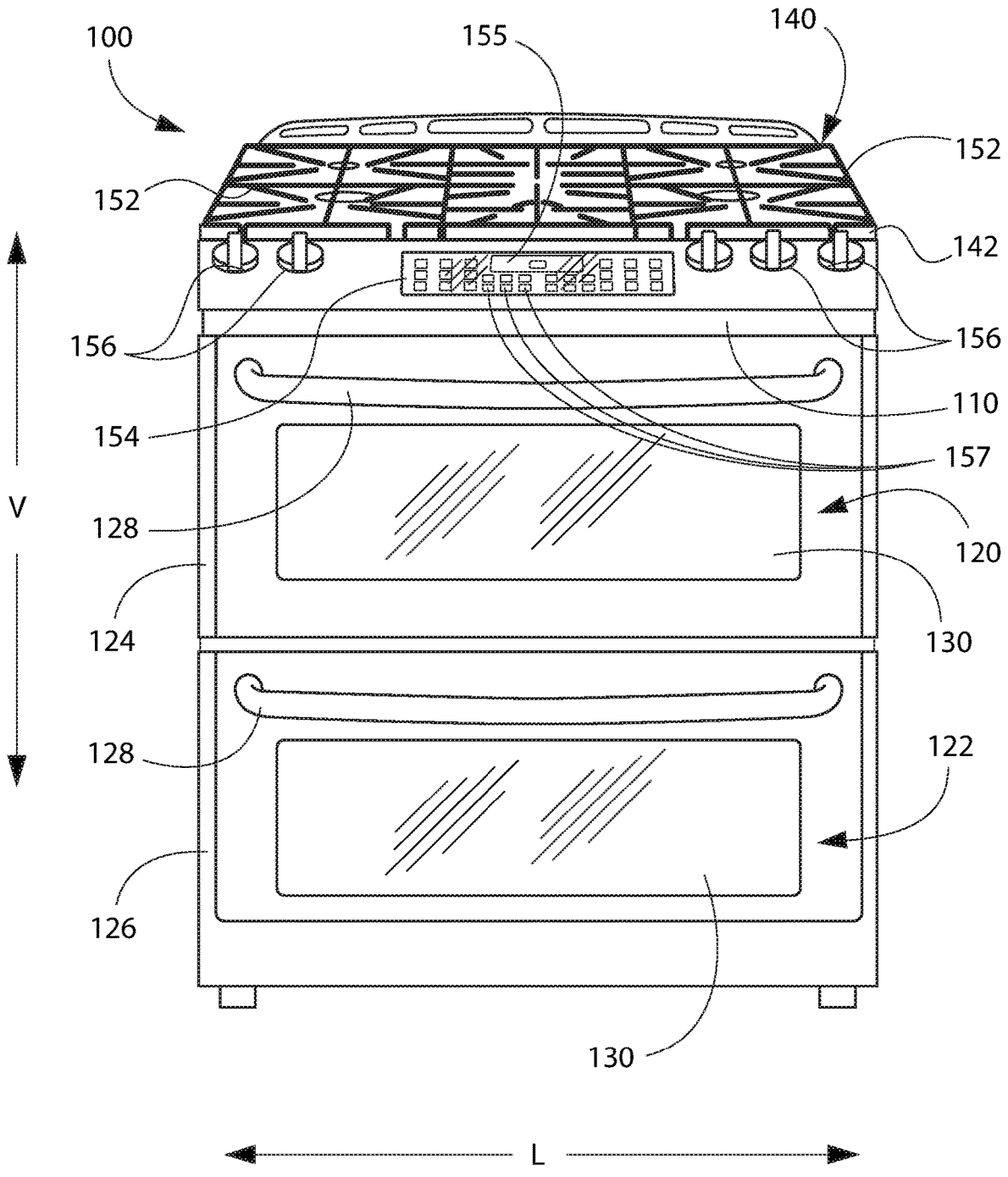
FIG. 1 provides a front, perspective view of a range appliance according to one or more example embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
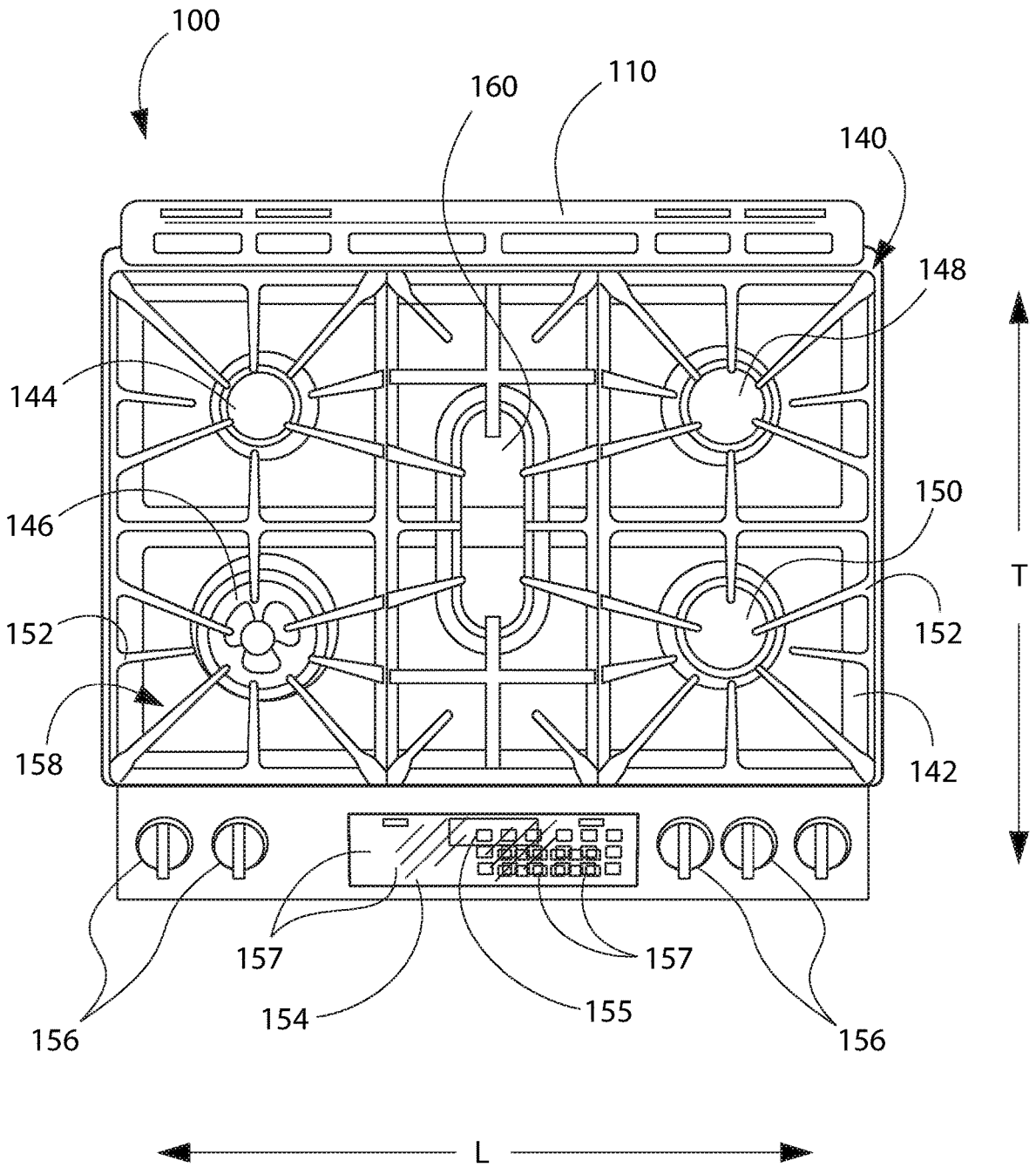
FIG. 2 provides a top, overhead view of the example range appliance of FIG. 1.

FIG. 1 provides a front, perspective view of a range appliance 100 as may be employed with the present subject matter. FIG. 2 provides a top, overhead view of range appliance 100. Range appliance 100 includes an insulated cabinet 110. Cabinet 110 defines an upper cooking chamber 120 and a lower cooking chamber 122. Thus, range appliance 100 is generally referred to as a double oven range appliance. As will be understood by those skilled in the art, range appliance 100 is provided by way of example only, and the present subject matter may be used in any suitable cooktop appliance, e.g., a single oven range appliance or a standalone cooktop appliance. Thus, the example embodiment shown in FIG. 1 is not intended to limit the present subject matter to any particular cooking chamber configuration or arrangement (or even the presence of a cooking chamber at all, e.g., as in the case of a standalone cooktop appliance).

Upper and lower cooking chambers 120 and 122 are configured for the receipt of one or more food items to be cooked. Range appliance 100 includes an upper door 124 and a lower door 126 rotatably attached to cabinet 110 in order to permit selective access to upper cooking chamber 120 and lower cooking chamber 122, respectively. Handles 128 are mounted to upper and lower doors 124 and 126 to assist a user with opening and closing doors 124 and 126 in order to access cooking chambers 120 and 122. As an example, a user can pull on handle 128 mounted to upper door 124 to open or close upper door 124 and access upper cooking chamber 120. Glass window panes 130 provide for viewing the contents of upper and lower cooking chambers 120 and 122 when doors 124 and 126 are closed and also assist with insulating upper and lower cooking chambers 120 and 122. Heating elements (not shown), such as electric resistance heating elements, gas burners, microwave heating elements, halogen heating elements, or suitable combinations thereof, are positioned within upper cooking chamber 120 and lower cooking chamber 122 for heating upper cooking chamber 120 and lower cooking chamber 122.

Range appliance 100 also includes a cooktop 140. Cooktop 140 is positioned at or adjacent a top portion of cabinet 110. Thus, cooktop 140 is positioned above upper and lower cooking chambers 120 and 122. Cooktop 140 includes a top panel 142. By way of example, top panel 142 may be constructed of glass, ceramics, enameled steel, and combinations thereof.

For range appliance 100, a utensil holding food and/or cooking liquids (e.g., oil, water, etc.) may be placed onto grates 152 at a location of any of burner assemblies 144, 146, 148, 150. Burner assemblies 144, 146, 148, 150 provide thermal energy to cooking utensils on grates 152. As shown in FIG. 2, burner assemblies 144, 146, 148, 150 can be configured in various sizes so as to provide e.g., for the receipt of cooking utensils (i.e., pots, pans, etc.) of various sizes and configurations and to provide different heat inputs for such cooking utensils. Grates 152 are supported on a top surface 158 of top panel 142. Range appliance 100 also includes a griddle burner 160 positioned at a middle portion of top panel 142, as may be seen in FIG. 2. A griddle may be positioned on grates 152 and heated with griddle burner 160.

A user interface panel 154 is located within convenient reach of a user of the range appliance 100. For this example embodiment, user interface panel 154 includes knobs 156 that are each associated with one of burner assemblies 144, 146, 148, 150 and griddle burner 160. Knobs 156 allow the user to activate each burner assembly and determine the amount of heat input provided by each burner assembly 144, 146, 148, 150 and griddle burner 160 to a cooking utensil located thereon. The user interface panel 154 may also include one or more inputs 157, such as buttons or a touch pad, for selecting or adjusting operation of the range appliance 100, such as for selecting or initiating a precision cooking mode, as will be described in more detail below. User interface panel 154 may also be provided with one or more graphical display devices 155 that deliver certain information to the user such as e.g., whether a particular burner assembly is activated and/or the temperature at which the burner assembly is set.

Although shown with knobs 156, it should be understood that knobs 156 and the configuration of range appliance 100 shown in FIG. 1 is provided by way of example only. More specifically, user interface panel 154 may include various input components, such as one or more of a variety of touch-type controls, electrical, mechanical or electro-mechanical input devices including rotary dials, push buttons, and touch pads. The user interface panel 154 may include other display components, such as a digital or analog display device 155, designed to provide operational feedback to a user.

Figure 3:
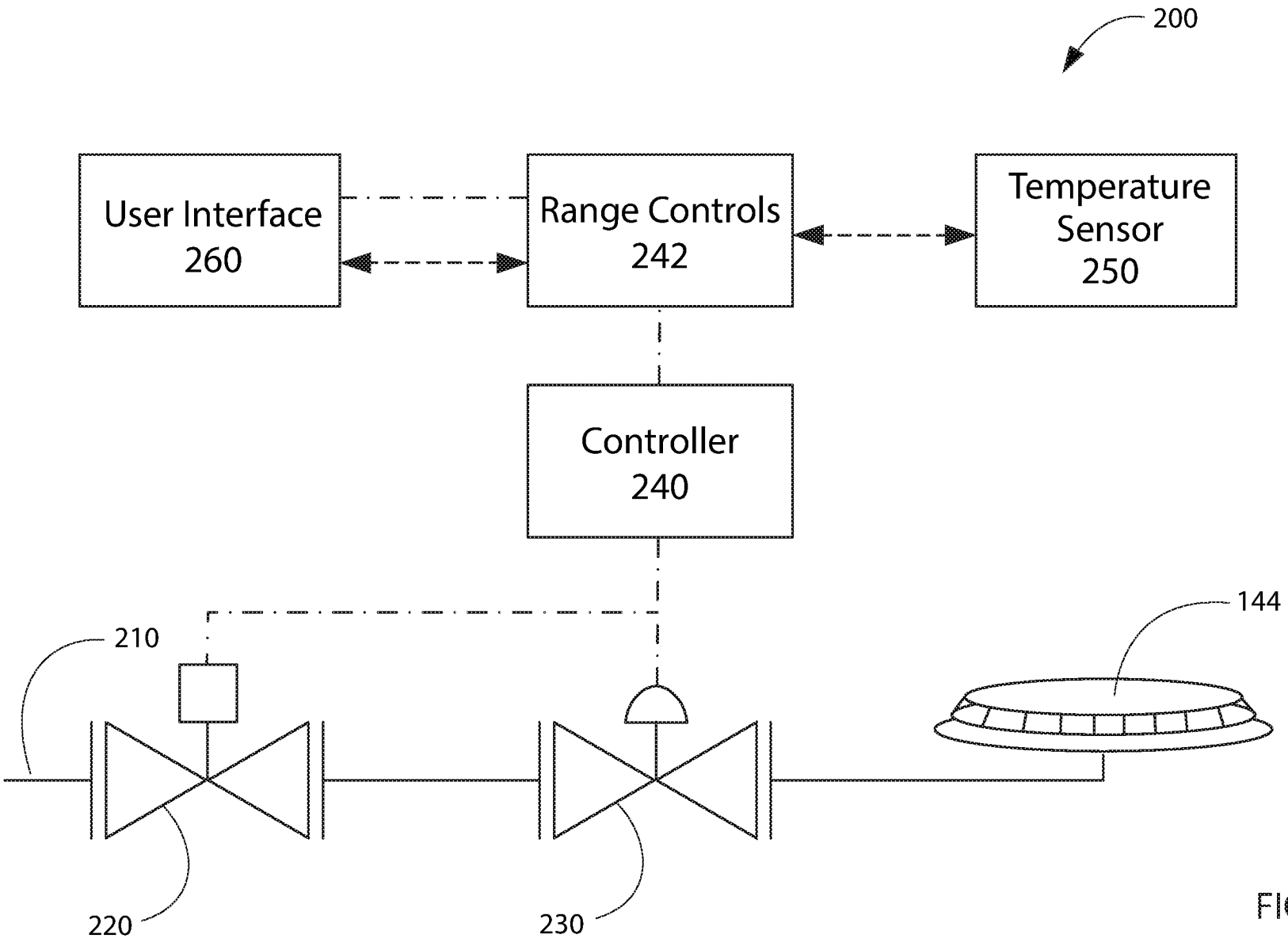
FIG. 3 is a schematic view of certain components of the example range appliance of FIG. 1.

FIG. 3 is a schematic view of certain components of range appliance 100. In particular, as shown in FIG. 3, range appliance 100 includes a fuel supply system 200. Fuel supply system 200 includes a supply line 210, a first control valve 220, and a second control valve 230. Supply line 210 may be a metal tube, such as copper or aluminum tubing, that is connectable to a fuel supply. Thus, supply line 210 may receive a flow of pressurized gaseous fuel, e.g., natural gas or propane, from the fuel supply. Supply line 210 also extends to burner assembly 144 within cabinet 110 below top panel 142. Thus, the gaseous fuel may flow from the fuel supply to burner assembly 144 through supply line 210. Although not shown in FIG. 3, the other burner assemblies 146, 148, 150 may be connected to supply line 210 in a similar manner.

The control valves 220 and 230 are coupled to supply line 210 in series and are configured for regulating the flow of gaseous fuel through supply line 210 to burner assembly 144. In particular, the control valves 220 and 230 may be operatively and/or communicatively coupled to one of knobs 156, e.g., via one or more controllers 240 and/or 242, as illustrated in FIG. 3 and described in more detail below, such that the control valves 220 and 230 are adjustable in response to a position of the corresponding knob 156 to regulate the flow of gaseous fuel to burner assembly 144, e.g., during a manual or open-loop operation of the range appliance 100. The control valves 220 and 230 may be electronic valves, e.g., the control valves 220 and 230 may be coupled to the corresponding knob 156 via one or more electronic controls. The control valves 220 and 230 may include one or more of an electronic pressure regulating valve, a motorized valve, a modulating valve, a solenoid valve, or some other variable type gas flow valve.

Figure 4:
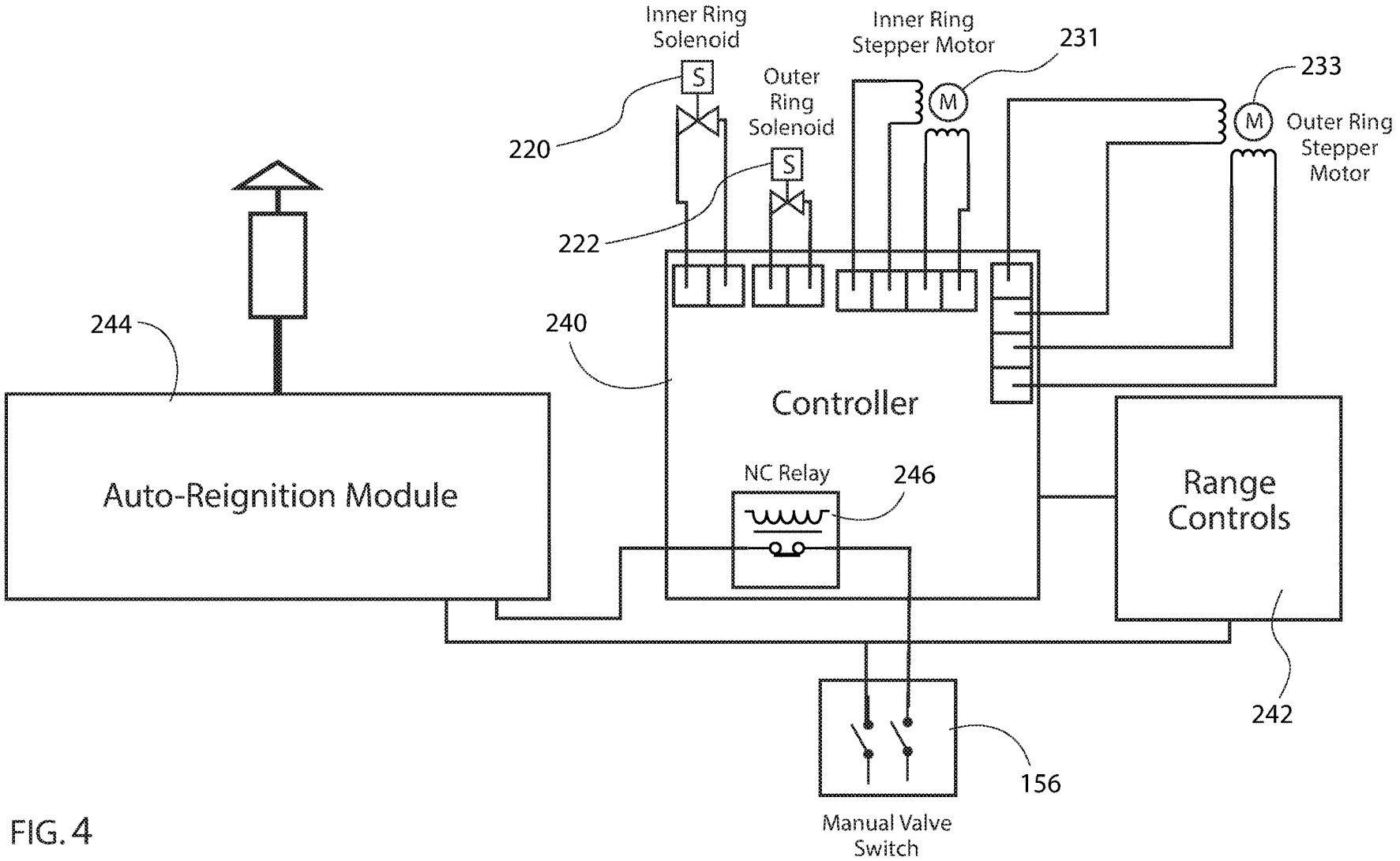
FIG. 4 provides a diagram of certain components of the example range appliance of FIG. 1.

For example, as illustrated in FIGS. 3 and 4, the second control valve 230 is connected in series between the first control valve 220 and burner assembly 144. Thus, the second control valve 230 may be positioned downstream of the first control valve 220 on supply line 210 relative to the flow of fuel from the fuel source. In such a manner, the first control valve 220 may be, e.g., a gate valve or a solenoid valve and may be movable between a fully open position and a fully closed position, and the second control valve 230 may further regulate the flow of gaseous fuel to burner assembly 144 after the first control valve 220. In some embodiments, the first control valve 220 may move only from the fully open position to the fully closed position, e.g., the first control valve 220 may be a binary or ON/OFF valve, and the second control valve 230 may be movable over a range of intermediate positions between fully open and fully closed, e.g., by a stepper motor as mentioned below. Control valves 220 and 230 may be coupled to one or more electronic controls. For example, the first control valve 220 may be actuated by a solenoid, e.g., as noted in FIG. 4, and the second control valve 230 may be actuated by a motor, such as a stepper motor (e.g., stepper motor 231 and/or 233 as illustrated in FIG. 4), which actuates the second control valve 230. In particular, control valves 220 and 230 may be operable in a precision cooking mode, e.g., utilizing a closed loop control system to regulate gaseous fuel flow to burner assembly 144, as discussed in greater detail below.

In precision cooking mode, control valves 220 and 230 may be automatically adjusted to regulate the flow of gaseous fuel to burner assembly 144. In some embodiments, range appliance 100 may include a controller 240 and range controls 242 that collectively regulate various components of range appliance 100, e.g., as illustrated in FIGS. 3 and 4. In other embodiments, the controller 240 and the range controls 242 may be combined or integrated into a single controller 240. Controller 240 is in operative communication with various components of range appliance 100, such as user interface 154, including the inputs 156, 157 and display 155 thereon, control valves 220 and 230, and/or a temperature sensor 250. In some embodiments, controller 240 may be in direct operative communication with the control valves 220 and 230 and may be in operative communication with the interface 154, including the inputs 156, 157 and display 155 thereon, and the temperature sensor 250 via the range controls 242. Thus, controller 240 may adjust the control valves 220 and 230 in order to regulate the flow of gaseous fuel to burner assembly 144. Signals may be routed between controller(s) 240 and/or 242 and the various operational components of range appliance 100. Thus, controller(s) 240 and/or 242 can selectively activate and operate these various components. Various components of range appliance 100 are communicatively coupled with controller (s) 240 and/or 242 via one or more communication lines, such as, e.g., signal lines, shared communication busses, or wirelessly.

Controller(s) 240 and/or 242 include memory and one or more processing devices such as microprocessors, CPUs or the like, such as general or special purpose microprocessors operable to execute programming instructions or micro-control code associated with operation of range appliance 100. The memory can be non-transitory and represent random access memory ("RAM") such as dynamic random access memory ("DRAM"), or read only memory such as ROM or FLASH. The processor executes programming instructions stored in the memory. The memory can be a separate component from the processor or can be included onboard within the processor. The memory can store information accessible by the processor(s), including instructions that can be executed by the processor(s). For example, the instructions can be software or any set of instructions that when executed by the processor(s), cause the processor(s) to perform operations. For the embodiment depicted, the instructions may include a software package configured to operate the system to, e.g., execute the exemplary methods described below. Alternatively, controller(s) 240 and/or 242 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 240 is also in communication with temperature sensor 250, e.g., via the range controls 242 in the illustrated example embodiments, although it should be understood that the range controls 242 may also be integrated with the controller 240 in other embodiments. Temperature sensor 250 is separate from burner assembly 144, and temperature sensor 250 is configured to measure a temperature at a utensil heated by burner assembly 144. Thus, temperature sensor 250 may be a thermistor or thermocouple positioned on and/or disposed within a utensil positioned above burner assembly 144 on cooktop 140. Range controls 242 receive temperature measurements from temperature sensor 250. For example, range controls 242 and temperature sensor 250 may each include a wireless transmitter/receiver such that controller 240 and temperature sensor 250 communicate with each other wirelessly, e.g., via a Bluetooth® or Wi-Fi® connection. In certain example embodiments, temperature sensor 250 is a separate component mountable to the utensil heated by burner assembly 144. In alternative example embodiments, temperature sensor 250 may be integrated within the utensil heated by burner assembly 144. For example, the temperature sensor 250 may be disposed within the utensil in that the temperature sensor 250 is positioned within an internal cooking volume defined in the utensil, or the temperature sensor 250 may be embedded in a wall of the cooking utensil.

In the example embodiment depicted in FIG. 4, the burner assembly 144 is a multi-ring burner, such that the first and second control valves 220 and 230 (FIG. 3) control a supply of gas to a first ring of the multi-ring burner, e.g., an inner ring, and the fuel supply system 200 further includes a third control valve 222 and a fourth control valve (not shown) which is actuated by a second stepper motor 233, where the third control valve 222 and the fourth control valve control a supply of gas to a second ring, e.g., an outer ring, of the multi-ring burner in a similar manner as described above with respect to the first and second control valves 220 and 230. As illustrated in FIG. 4, the first and third control valves 220 and 222 may be solenoid valves, and the second and fourth control valves may be actuated by a first stepper motor 231 corresponding to the second control valve 230 and a second stepper motor 233 corresponding to the fourth control valve. As mentioned above, in other embodiments, any suitable variable type gas flow valves may be used.

Combustion may be initiated in the associated burner assembly 144 by an ignition module 244 which will call for a spark at an igniter of the burner assembly 144. As illustrated in FIG. 4, the ignition module 244 may be connected to the controller 240 via a normally-closed relay 246 which permits a signal from the controller 240, e.g., in response to an input received by the controller 240 from the knob 156 and/or from the range controls 242, to be transmitted to the ignition module 244 so long as the relay remains closed. With the control valves 220 and 230 open such that fuel is provided to the burner assembly 144, sparking the igniter may initiate combustion of the fuel at the burner assembly 144. The ignition module 244 may also be or include an auto-reignition module 244 which is operable to detect a presence of flame at the burner assembly 144 and to automatically spark the igniter when the knob 156 is not in an "OFF" setting and a flame is not detected at the burner assembly 144.

According to various embodiments of the present disclosure, the range appliance 100 may be configured for a precision cooking mode and/or methods of operating the range appliance 100 may include precision cooking mode. Precision cooking mode generally includes a closed-loop control algorithm used to automatically (e.g., without user input such as adjusting the knobs 156) adjust the flow of gas to one or more of the burner assemblies 144, 146, 148, 150 and griddle burner 160. Utilizing temperature measurements from temperature sensor 250 and/or range controls 242, controller 240 may adjust the first and second control valves 220 and 230 (which may include, e.g., adjusting a position of the stepper motor 231) and regulate the flow of gaseous fuel to, e.g., burner assembly 144. In some embodiments, the precision cooking mode operation may be performed at least in part by a closed loop control algorithm carried out by the range controls 242, e.g., the range controls 242 may send and receive signals to and from the controller 240, whereby the range controls 242 receives the user-determined set temperature and a temperature measurement from the temperature sensor 250, then determines an output of the closed-loop control algorithm, such as a requested power level of the burner, based on the user-determined set temperature and the temperature measurement. The range controls 242 may then transmit the output, e.g., requested power level, to the controller 240. In additional embodiments, the closed loop control system 242 may be incorporated onboard and/or integrated into the controller 240. In some embodiments, the user may turn on the closed loop controls by initiating precision cooking mode, such as by pressing a corresponding one of the inputs 157 on the user interface 154. Other inputs 157 of the user interface 154 may be used to input a user-defined set temperature or target temperature for the cooking operation.

When the precision cooking mode is activated, controller 240 and/or range controls 242 receives the temperature measurements from temperature sensor 250 and compares the temperature measurements to a target temperature, e.g., the user-defined set temperature. In order to reduce a difference between the temperature measurements from temperature sensor 250 and the target temperature, controller 240 adjusts the flow of gaseous fuel to burner assembly 144 with control valves 220 and 230, for example, such adjustment may be according to a requested power level which is output from the closed-loop control algorithm performed by the range controls 242. In particular, controller 240 may adjust control valves 220 and 230 to decrease the flow of gaseous fuel to burner assembly 144 when the temperature measurements from temperature sensor 250 are greater than the set temperature. Conversely, controller 240 may adjust control valves 220 and 230 to increase the flow of gaseous fuel to burner assembly 144 when the temperature measurements from temperature sensor 250 are less than the set temperature. Thus, the heat output provided by burner assembly 144 may be regulated by the closed loop control system, e.g., without additional user input and/or monitoring.

A user may establish the set temperature via a user interface 260, e.g., the user interface 260 may include inputs 157 and a display 155, as in the illustrated example embodiment. Controller 240 and/or range controls 242 is or are in communication with user interface 260 and configured to receive the user-determined set temperature from user interface 260. User interface 260 may correspond to user interface panel 154 in certain example embodiments. Thus, the user may, for example, utilize keys 157 on user interface panel 154 to establish the set temperature. In such example embodiments, user interface 260 is positioned on top panel 142 and may be in communication with controller(s) 240 and/or 242 via a wiring harness. As another example, user interface 260 may correspond to an application on a smartphone or other device, and the user may utilize the application to establish the set temperature. In such example embodiments, user interface 260 may be in wireless communication with controller(s) 240 and/or 242, e.g., via a Bluetooth® or Wi-Fi® connection.

Figure 5:
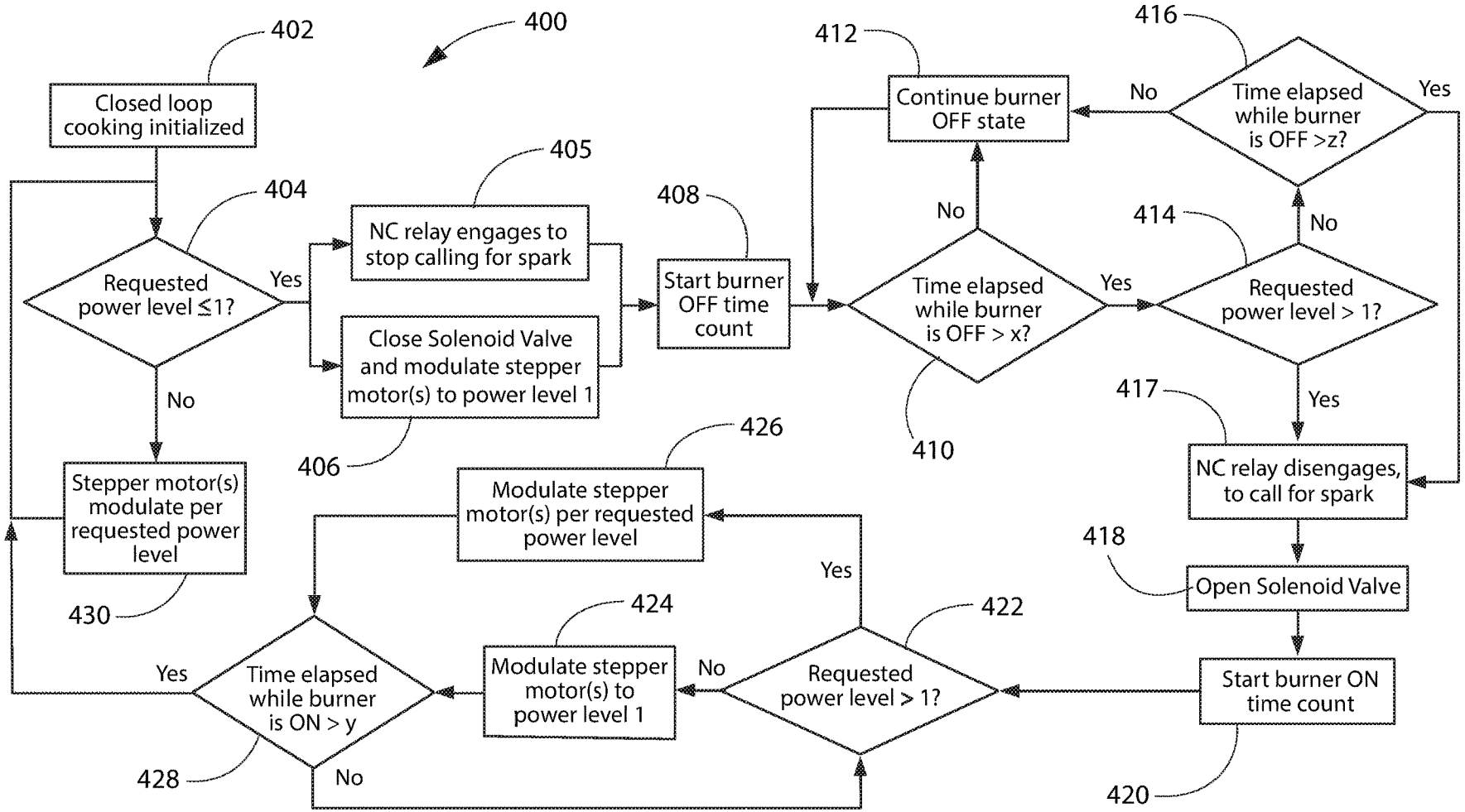
FIG. 5 provides a flow chart illustrating an exemplary method of operating a cooktop appliance according to one or more example embodiments of the present subject matter.

Turning now to FIG. 5, an example method 400 of operating a cooktop appliance, such as the example range appliance 100 described above, is illustrated. The method 400 may include a step 402 of initializing closed-loop cooking, such as in response to receiving a precision mode initiation signal from the user interface. The precision mode initiation signal may represent or correspond to a user request for precision cooking mode based on a user pressing a precision cooking mode key or button 157 or otherwise entering the request via the user interface 260. It will be understood that the precision cooking mode includes a target temperature, e.g., the method 400 may also include receiving a user-determined set temperature from a user interface, e.g., user interface 260, of the cooktop appliance, and the user interface may include at least one user input and a display. The precision cooking mode utilizes a closed-loop control system, which may operate or adjust the cooktop appliance based on input from the temperature sensor, e.g., the method 400 may also include receiving a temperature measurement from the temperature sensor. Initializing closed-loop cooking may also include activating at least one burner of the cooktop appliance, such as one of burner assemblies 144, 146, 148, 150 and griddle burner 160.

After initializing closed-loop cooking at step 402, the method 400 may include inputting the user-determined set temperature and the temperature measurement into a closed-loop control algorithm, for example, the closed-loop control algorithm may be a PID (proportional-integral-derivative) algorithm. The closed-loop control algorithm may be carried out by, for example, the range controls 242. The closed-loop control algorithm then produces an output based on the user-determined set temperature and the temperature measurement. The output may be a requested power level. The method 400 may include a step 404 of comparing the output of the closed-loop control algorithm, e.g., the requested power level, to a threshold power level. For example, as illustrated in FIG. 5, the threshold power level may be 1, which may represent or correspond to the lowest sustainable burner output in order to provide steady and stable combustion. In some embodiments, the threshold power level may correspond to between about 600 BTU and about 650 BTU burner output, or an operating temperature of about 200° F., depending on the food load, utensil type and size, etc.

When the requested power level is greater than or equal to the threshold power level at step 404, the method 400 may proceed to step 430, where the control valve or valves is or are adjusted according to the requested power level. For example, in some embodiments such as the examples illustrated in FIGS. 3 through 5, adjusting the control valve may include modulating a stepper motor, such as stepper motor 231 in FIG. 4, connected to the control valve, e.g., second control valve 230, to the requested power level. Further, in some embodiments, the step 406 may include modulating more than one stepper motor, e.g., a first stepper motor 231 and a second stepper motor 233, as illustrated in FIG. 4, to the requested power level.

When the requested power level is less than the threshold power level at step 404, the method 400 may proceed to step 405 and/or step 406, as illustrated in FIG. 5. Step 406 may include closing the first control valve 220 which may be, e.g., a solenoid valve in some embodiments, and in additional embodiments, e.g., as illustrated in FIG. 4 where multiple rings are provided, step 406 may include closing both (or each) solenoid valve for each ring, such as closing the inner ring solenoid valve 220 and the outer ring solenoid valve 222. Step 406 may also include modulating the second control valve 230, e.g., via the corresponding stepper motor 231, to the threshold power level. Additionally, in at least some embodiments, the method 400 may include step 405 of deactivating a re-ignition module of the cooktop appliance when the output of the closed-loop control algorithm is less than the threshold power level, for example by engaging the normally-closed relay 246 to stop the auto-reignition module 244 calling for a spark when the auto-reignition module 244, such as an igniter thereof, does not detect flame at the burner.

After turning the burner OFF, e.g., by closing the first control valve 220 (e.g., solenoid valve 220 in some embodiments) and/or disabling ignition, the method 400 may include a step 408 of starting a burner OFF time count. The burner OFF time count may be used to provide a minimum OFF time X and/or a maximum OFF time Z. In various embodiments, the minimum OFF time X may be between about ten seconds and about one minute, such as between about fifteen seconds and about forty-five seconds, such as about twenty seconds. In various embodiments, the maximum OFF time Z may be less than or equal to about two minutes, such as about ninety seconds, or about one minute, among other examples. In embodiments where the minimum OFF time X and the maximum OFF time Z are both included, the maximum OFF time Z is greater than the minimum OFF time X.

For example, the method 400 may include a step 410 of comparing the burner OFF time count to the minimum OFF time X. When the burner OFF time count is not greater than, i.e., is less than or equal to, the minimum OFF time X (e.g., when the result at 410 in FIG. 5 is NO), the method 400 may proceed to step 412, where the burner OFF state is continued, and the method 400 may then iterate steps 410 and 412 until the burner OFF time count is greater than the minimum OFF time X.

When the burner OFF time count is greater than the minimum OFF time X, the method 400 may then include an additional comparing step 414 of comparing the output of the closed-loop control algorithm to the threshold power level.

When the closed-loop control output is still not greater than the power level threshold after allowing the minimum OFF time to elapse, e.g., when the burner OFF time count is greater than the minimum OFF time X and the requested power level is less than or equal to the power level threshold, the method 400 may continue to a step 416 of determining whether the burner OFF time count is greater than the maximum OFF time Z (i.e., when the requested power level is not greater than the power level threshold, as indicated in FIG. 5, where step 416 follows the "No" from step 414). If the minimum burner OFF time X has elapsed, the requested power level is still less than or equal to the power threshold, and the maximum OFF time Z has not elapsed, e.g., the burner OFF time count is less than or equal to Z, as indicated at 416 in FIG. 5, the method 400 may return to step 412, where the burner OFF state is continued, and the method 400 may then iterate steps 410, 414, 416, and 412 until the requested power level is greater than the power level threshold or the burner OFF time count is greater than the maximum OFF time Z.

When the output of the closed-loop control algorithm, e.g., the requested power level, is greater than the threshold power level after the minimum OFF time X at step 414, the method 400 may then continue to step 418 and step 417. The method 400 may also continue to step 418 and step 417 when the burner OFF time count is greater than the maximum OFF time Z.

For example, in embodiments where the method 400 includes deactivating the re-ignition module of the cooktop appliance when the output of the closed-loop control algorithm is less than the threshold power level, e.g., by engaging a normally-closed relay at step 405, the method 400 may also include a step 417 of re-activating the re-ignition module, e.g., by disengaging the normally-closed relay such that a call for spark may be initiated by the re-ignition module.

In some embodiments, method 400 may include opening the first control valve, e.g., solenoid valve as in the illustrated embodiments, at step 418, e.g., as illustrated in FIG. 5. Step 418 may be performed when the burner OFF time count is greater than a minimum OFF time (step 410) and the output of the closed-loop control algorithm is greater than the threshold power level (step 414), and/or may be performed when the burner OFF time count is greater than the maximum OFF time Z (step 416).

After opening the solenoid valve at step 418 and, in at least some embodiments, re-activating the re-ignition module at step 417, the method 400 may also include starting a burner ON time count, e.g., as illustrated at step 420 in FIG. 5. The method 400 may also include comparing the burner ON time count to a minimum ON time Y. For example, as illustrated in FIG. 5, the method 400 may include a step 428 of determining whether the time elapsed while the burner is ON, e.g., the burner ON time count, is greater than the minimum ON time Y. In various embodiments, the minimum ON time Y may be between about five seconds and about thirty seconds, such as between about ten seconds and about twenty-five seconds, such as about twenty seconds, about ten seconds, among other examples.

While the burner is ON, e.g., while the control valves are open and thereby fuel is supplied to the burner and the ignition module is activated to provide ignition, and after starting the burner ON time count, the method 400 may compare the output of the closed-loop control algorithm to the threshold power level, e.g., as illustrated at step 422 in FIG. 5, the method 400 may include determining whether the requested power level is greater than the threshold power level.

As long as the requested power level is greater than the power level threshold, e.g., when the determination at step 422 is positive ("Yes" as indicated in FIG. 5), the method 400 may include modulating the second control valve and/or an actuator thereof, such as the stepper motor, to the requested power level at step 426. When the determination at step 422 is negative, e.g., "No," as indicated in FIG. 5, where the output of the closed-loop control algorithm, e.g., the requested power level, is not greater than the threshold power level, the method 400 may then include a step 424 of modulating the second control valve and/or the corresponding stepper motor to the threshold power level.

When the requested power level is not greater than the power level threshold at step 422 but the burner ON time count is not greater than the minimum ON time Y at step 428, then the method 400 returns to step 422 and iterates the successive steps 422, 424, and 428 until step 428 leads to a "Yes," e.g., until the burner ON time is greater than the minimum burner ON time Y. Thus, the method may include and/or the cooktop appliance may be configured to operate the burner at a minimum level for at least the minimum ON time even while the output of the closed-loop algorithm is calling for a power level less than the minimum level.

After the minimum ON time Y has elapsed, e.g., as may be seen by following the "Yes" branch from 428 in FIG. 5, the method 400 may then return to step 404 and compare the requested power level to the power level threshold. At this point, the minimum ON time Y having been satisfied, the method 400 may, e.g., when the requested power level is less than the power threshold at step 404, turn the burner OFF.

As may be seen from the above, the present disclosure provides a precision cooking mode, e.g., a closed-loop control system for operation of a cooktop appliance, which includes increased flexibility of operation, including a closed-loop controlled simmer setting, and cooktop appliances configured to operate according to such methods. For example, the present disclosure may provide a closed-loop cooking mode wherein excessive sparking of the igniter and/or excessive cycling (turning ON and OFF) of the burner may be avoided by use of minimum OFF time, maximum OFF time, and/or minimum ON time.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a cooktop appliance, the cooktop appliance comprising a gas burner, the method comprising:

receiving a user-determined set temperature from a user interface of the cooktop appliance;

activating the gas burner;

receiving a precision mode initiation signal from the user interface;

receiving a temperature measurement from a temperature sensor configured to measure a temperature at a utensil heated by the gas burner;

inputting the user-determined set temperature and the temperature measurement into a closed-loop control algorithm, whereby the closed-loop control algorithm produces an output based on the user-determined set temperature and the temperature measurement;

comparing the output of the closed-loop control algorithm to a threshold power level;

closing a first control valve to the gas burner when the output of the closed-loop control algorithm is less than the threshold power level; and starting a burner OFF time count after closing the first control valve and opening the first control valve when the burner OFF time count is greater than a minimum OFF time and the output of the closed-loop control algorithm is greater than the threshold power level.

2. The method of claim 1, further comprising deactivating a re-ignition module of the cooktop appliance when the output of the closed-loop control algorithm is less than the threshold power level, and re-activating the re-ignition module when the burner OFF time count is greater than the minimum OFF time and the output of the closed-loop control algorithm is greater than the threshold power level.

3. The method of claim 2, further comprising starting a burner ON time count after opening the first control valve.

4. The method of claim 3, further comprising comparing the output of the closed-loop control algorithm to the threshold power level after starting the burner ON time count.

5. The method of claim 4, further comprising modulating a second control valve of the cooktop appliance to the power level threshold after comparing the output of the closed-loop control algorithm to the threshold power level when the output of the closed-loop control algorithm is less than the threshold power level and the burner ON time count is less than or equal to a minimum ON time.

6. The method of claim 4, further comprising modulating a second control valve of the cooktop appliance to a power level corresponding to the output of the closed-loop control algorithm after comparing the output of the closed-loop control algorithm to the threshold power level when the output of the closed-loop control algorithm is greater than the threshold power level.

7. The method of claim 4, further comprising closing the first control valve to the gas burner when the burner ON time count is greater than a minimum ON time and the output of the closed-loop control algorithm is less than the threshold power level.

8. The method of claim 1, further comprising opening the first control valve when the burner OFF time count is greater than a maximum OFF time.

9. The method of claim 1, wherein the closed-loop control algorithm is a PID control loop.

10. A method of operating a cooktop appliance, the cooktop appliance comprising a gas burner, the method comprising:

receiving a user-determined set temperature from a user interface of the cooktop appliance;

activating the gas burner;

receiving a precision mode initiation signal from the user interface;

receiving a temperature measurement from a temperature sensor configured to measure a temperature at a utensil heated by the gas burner;

inputting the user-determined set temperature and the temperature measurement into a closed-loop control algorithm, whereby the closed-loop control algorithm produces an output based on the user-determined set temperature and the temperature measurement;

comparing the output of the closed-loop control algorithm to a threshold power level;

closing a first control valve to the gas burner when the output of the closed-loop control algorithm is less than the threshold power level; and starting a burner OFF time count after closing the first control valve and opening the first control valve when the burner OFF time count is greater than a maximum OFF time.

11. The method of claim 10, further comprising deactivating a re-ignition module of the cooktop appliance when the output of the closed-loop control algorithm is less than the threshold power level, and re-activating the re-ignition module when the burner OFF time count is greater than the maximum OFF time.

12. The method of claim 10, further comprising starting a burner ON time count after opening the first control valve.

13. The method of claim 12, further comprising comparing the output of the closed-loop control algorithm to the threshold power level after starting the burner ON time count.

14. The method of claim 13, further comprising modulating a second control valve of the cooktop appliance to the power level threshold after comparing the output of the closed-loop control algorithm to the threshold power level when the output of the closed-loop control algorithm is less than the threshold power level and the burner ON time count is less than or equal to a minimum ON time.

15. The method of claim 13, further comprising modulating a second control valve of the cooktop appliance to a power level corresponding to the output of the closed-loop control algorithm after comparing the output of the closed-loop control algorithm to the threshold power level when the output of the closed-loop control algorithm is greater than the threshold power level.

16. The method of claim 13, further comprising closing the first control valve to the gas burner when the burner ON time count is greater than a minimum ON time and the output of the closed-loop control algorithm is less than the threshold power level.

17. The method of claim 10, further comprising opening the first control valve when the burner OFF time count is greater than a minimum OFF time and the output of the closed-loop control algorithm is greater than the threshold power level.

18. The method of claim 10, wherein the closed-loop control algorithm is a PID control loop.

* * * * *